US009982682B2

(12) United States Patent
Ohtachi et al.

(10) Patent No.: US 9,982,682 B2
(45) Date of Patent: May 29, 2018

(54) ROTOR AND VACUUM PUMP EQUIPPED WITH SAME

(71) Applicant: Edwards Japan Limited, Yachiyo-shi, Chiba (JP)

(72) Inventors: Yoshinobu Ohtachi, Yachiyo (JP); Yasushi Maejima, Yachiyo (JP); Tsutomu Takaada, Yachiyo (JP); Yoshiyuki Sakaguchi, Yachiyo (JP); Yoshiyuki Takai, Yachiyo (JP)

(73) Assignee: Edwards Japan Limited, Yachiyo-shi (JP)

( * ) Notice: Subject to any disclaimer, the term of this patent is extended or adjusted under 35 U.S.C. 154(b) by 245 days.

(21) Appl. No.: 14/429,645

(22) PCT Filed: Sep. 18, 2013

(86) PCT No.: PCT/JP2013/075107
§ 371 (c)(1),
(2) Date: Mar. 19, 2015

(87) PCT Pub. No.: WO2014/050648
PCT Pub. Date: Apr. 3, 2014

(65) Prior Publication Data

US 2015/0240829 A1 Aug. 27, 2015

(30) Foreign Application Priority Data

Sep. 26, 2012 (JP) ..... 2012-211892

(51) Int. Cl.
*F04D 19/04* (2006.01)
*F04D 29/051* (2006.01)
(Continued)

(52) U.S. Cl.
CPC ..... *F04D 29/051* (2013.01); *F04D 19/042* (2013.01); *F04D 19/044* (2013.01);
(Continued)

(58) Field of Classification Search
CPC .... F04D 29/051; F04D 19/042; F04D 19/044; F04D 19/046; F04D 19/048;
(Continued)

(56) References Cited

U.S. PATENT DOCUMENTS 5,536,148 A * 7/1996 Nishiuchi ..... F04D 17/168 415/143
5,800,127 A * 9/1998 D'Angelo ..... F16F 15/34 416/144
(Continued)

FOREIGN PATENT DOCUMENTS

CN 1429994 A 7/2003
EP 1302667 B1 12/2004
(Continued)

OTHER PUBLICATIONS

Translation of and original International Search Report dated Oct. 15, 2013 in counterpart International Application No. PCT/JP2013/075107, 5 pgs.

*Primary Examiner* — Kenneth Bomberg
*Assistant Examiner* — Brian Delrue
(74) *Attorney, Agent, or Firm* — Shumaker & Sieffert, P.A.

(57) ABSTRACT

A rotor of a vacuum pump has first and second cylindrical bodies and a connecting portion for connecting the end portions of the cylindrical bodies together. The first cylindrical body has a plurality of rotor blades on an outer circumferential surface thereof, and configures a blade exhaust portion when the rotor blades are arranged along an axial center of the vacuum pump alternately with a plurality of stator blades. The second cylindrical body configures a threaded groove exhaust portion when a threaded groove exhaust flow passage is formed at least on an inner circumference of the second cylindrical body. In this rotor, a balancing portion for the rotor is provided on an inner
(Continued)

circumferential surface of the first cylindrical body or the connecting portion, and mass adding means is provided in the balancing portion.

12 Claims, 9 Drawing Sheets

(51) Int. Cl.
*F04D 29/66* (2006.01)
*F04D 29/02* (2006.01)
*F04D 29/058* (2006.01)
*F04D 29/08* (2006.01)
*F04D 29/38* (2006.01)

(52) U.S. Cl.
CPC ..... *F04D 19/046* (2013.01); *F04D 19/048* (2013.01); *F04D 29/023* (2013.01); *F04D 29/058* (2013.01); *F04D 29/083* (2013.01); *F04D 29/38* (2013.01); *F04D 29/662* (2013.01); *F05D 2260/95* (2013.01)

(58) Field of Classification Search
CPC .... F04D 29/023; F04D 29/058; F04D 29/083; F04D 29/38; F04D 29/662; F04D 29/644; F04D 29/66; F04D 29/661; F04D 29/668; F05D 2260/95
USPC ..... 416/144; 415/147.1
See application file for complete search history.

(56) References Cited

U.S. PATENT DOCUMENTS

| | | | | |
|---|---|---|---|---|
| 6,457,954 | B1 | 10/2002 | Adamietz et al. | |
| 6,890,145 | B2 * | 5/2005 | Takamine | F04D 19/04 415/217.1 |
| 2003/0021673 | A1 | 1/2003 | Maejima et al. | |
| 2003/0086784 | A1 | 5/2003 | Stuart | |
| 2003/0095860 | A1 * | 5/2003 | Takamine | F04D 19/04 415/90 |
| 2013/0149105 | A1 * | 6/2013 | Sakaguchi | F04D 19/042 415/68 |
| 2013/0164124 | A1 * | 6/2013 | Ohtachi | F04D 19/042 415/183 |
| 2013/0170955 | A1 * | 7/2013 | Sakaguchi | F04D 19/042 415/116 |

FOREIGN PATENT DOCUMENTS

| | | | | |
|---|---|---|---|---|
| JP | 2003-021093 | | 1/2003 | |
| JP | 2003-065281 | | 3/2003 | |
| JP | 2003-148389 | | 5/2003 | |
| JP | 2004-278512 | A | 10/2004 | |
| JP | 3971821 | B2 | 9/2007 | |
| JP | 3974772 | B2 | 9/2007 | |
| WO | 2012043035 | A1 | 4/2012 | |
| WO | WO 2012043035 | A1 * | 4/2012 | F04D 19/042 |

* cited by examiner

[FIG. 1]

FIG. 4
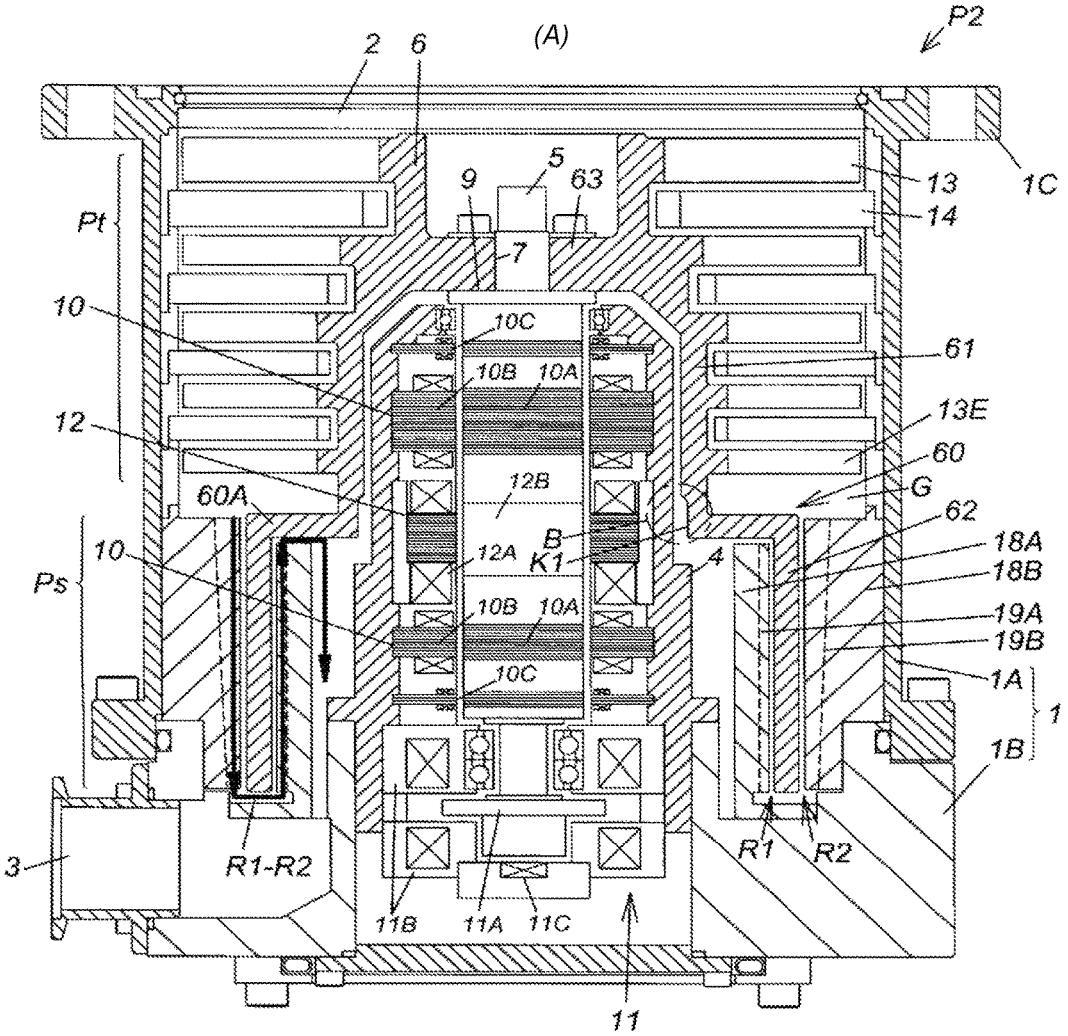
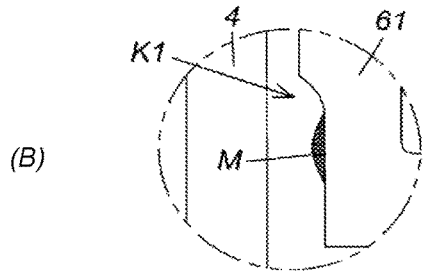

[FIG.8]
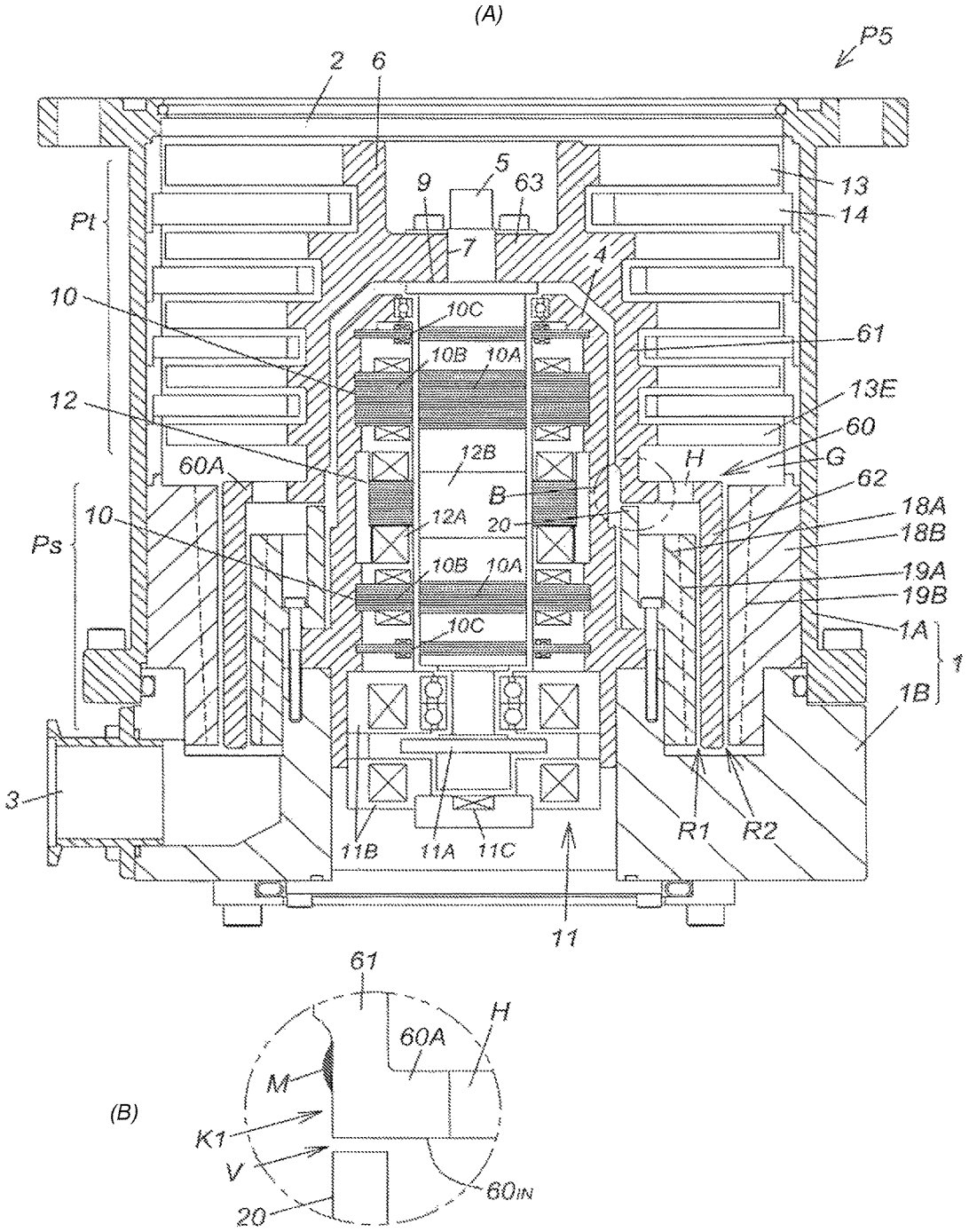

[FIG.9]
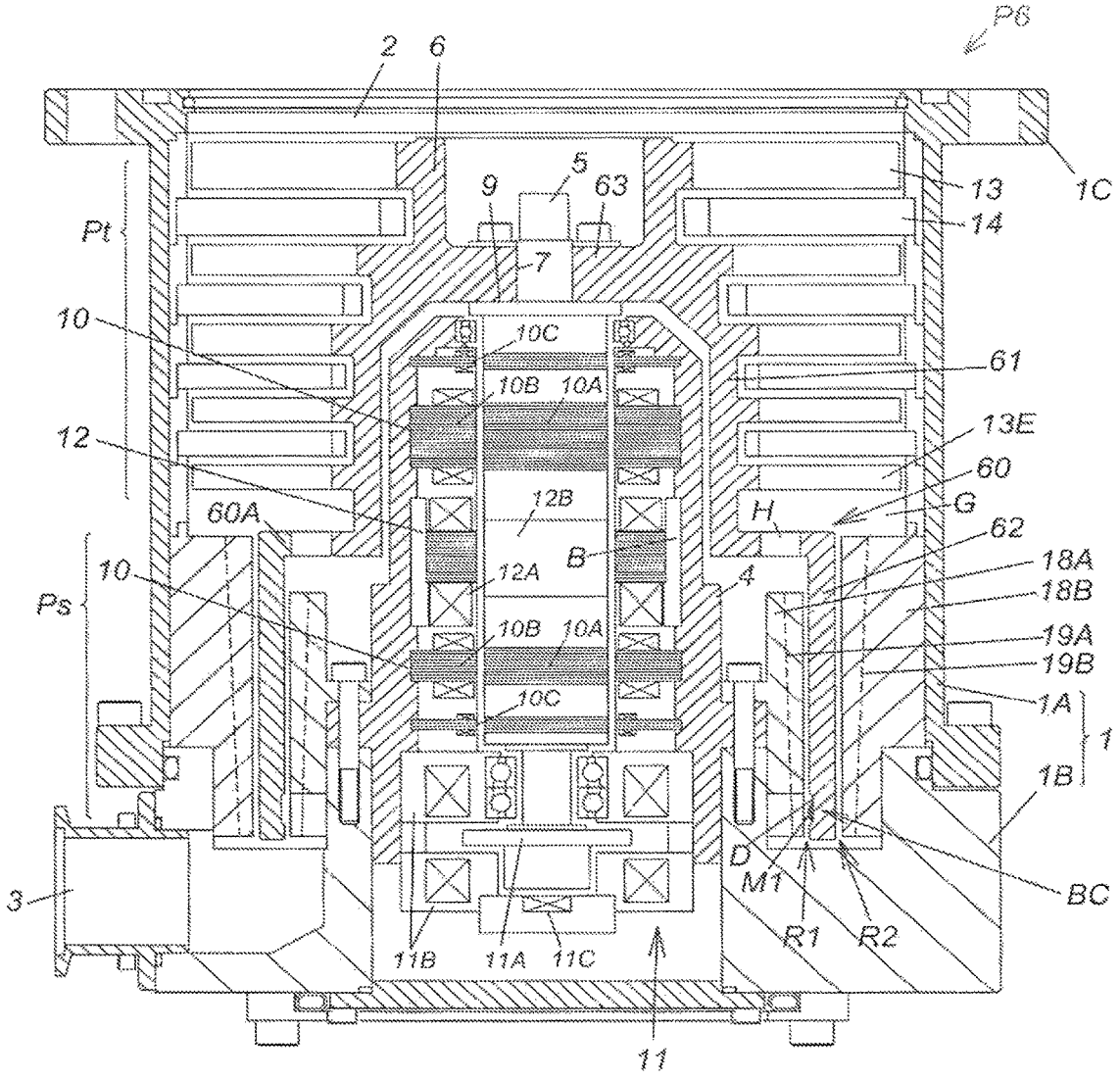
PRIOR ART

[FIG.10]
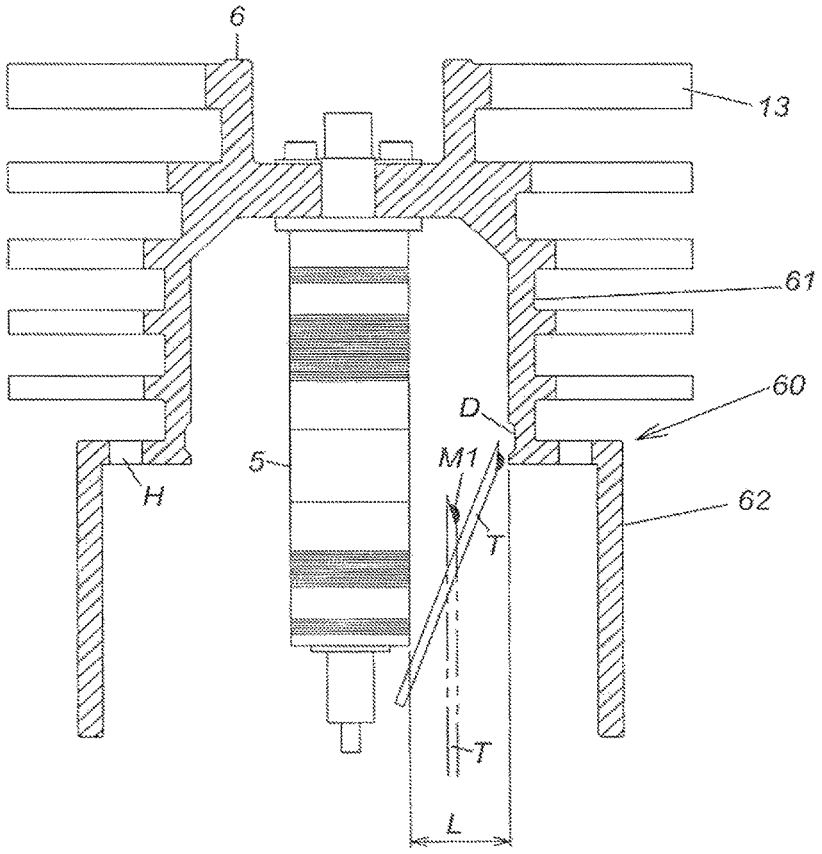
PRIOR ART

ROTOR AND VACUUM PUMP EQUIPPED WITH SAME

This application is a national stage entry under 35 U.S.C. § 371 of International Application No. PCT/JP2013/075107, filed Sep. 18, 2013, which claims the benefit of JP Application 2012-211892, filed Sep. 26, 2012. The entire contents of International Application No. PCT/JP2013/075107 and JP Application 2012-211892 are incorporated herein by reference.

TECHNICAL FIELD

The present invention relates to a rotor for a vacuum pump which is for use as gas exhaust means of a process chamber and other closed chambers for a semiconductor manufacturing apparatus, a flat panel display manufacturing apparatus, and a solar panel manufacturing apparatus. The present invention also relates to a vacuum pump equipped with such a rotor.

BACKGROUND

A vacuum pump disclosed in, for example, Japanese Patent No. 3974772 has been known as a vacuum pump for exhausting gas from a chamber by means of the rotation of a rotor. In this vacuum pump, the entire rotating body that has the rotor (8) and rotor blades (10) provided integrally with an outer circumferential surface of the rotor (8) needs to be balanced during the assembly stage of the vacuum pump.

Especially in this vacuum pump of Japanese Patent No. 3974772 that exhausts a corrosive gas, since a corrosion protection membrane such as a nickel-phosphorus plated coating is formed on the surface of the rotor (8), the entire rotating body is balanced while preventing corrosion of the rotor (8) by the application of a synthetic resin adhesive as the mass adding means to the region of the surface where the corrosion protection membrane is formed (see paragraph 0008 and FIGS. 1 to 3 in Japanese Patent No. 3974772).

In regard to this type of vacuum pump, the following configurations have been known to further improve the evacuation performance: a configuration in which a part of a rotor made of a metallic material such as an aluminum alloy is made of a material such as a fiber-reinforced resin that is lighter and stronger than the metallic material (see Japanese Patent Application Publication No. 2004-278512, for example), and a configuration, such as that of the conventional vacuum pump (the threaded groove pump parallel flow type) shown in FIG. 9 of the present application, in which threaded groove exhaust flow passages R1, R2 are arranged in parallel in order to exhaust gas by means of the rotation of a rotor 6 (see Japanese Patent No. 3971821, for example).

However, according to the conventional vacuum pump (the parallel flow type) shown in FIG. 9 of the present application, the downstream region from substantially the middle of the rotor 6 (a connecting portion 60, to be precise) (between substantially the middle of the rotor 6 and an end portion of the rotor 6 at a gas outlet port 3 side) functions as a threaded groove exhaust portion Ps. This region of the threaded groove exhaust portion Ps is provided with the threaded groove exhaust flow passages R1, R2 on the inner and outer circumferences of the rotor 6 to make the threaded groove exhaust flow passages parallel and achieve further improvement of the evacuation performance. Therefore, applying the conventional balancing technique of Japanese Patent No. 3974772 to the conventional vacuum pump (parallel flow type) shown in FIG. 9 of the present application creates the following problems.

As shown in FIG. 9 of the present application, a synthetic resin adhesive M1 is applied to the inner circumferential surface of the rotor 6 opposing an inner threaded groove 19A, to obtain a balancing portion BC, which makes the effective thread length of the entire threaded groove exhaust portion Ps short, deteriorating the evacuation performance of the vacuum pump P6.

As shown in FIG. 9 of the present application, the balancing portion BC formed by the application of the synthetic resin adhesive M1 is exposed to the threaded groove exhaust flow passage R1 on the inner circumference side of the rotor 6, and the exposed synthetic resin adhesive M1 is exposed to the corrosive gas contained in the threaded groove exhaust flow passage R1. Consequently, the synthetic resin adhesive M1 for achieving the balance breaks into fragments due to corrosion thereof, which possibly end up flowing out to the process chamber or other closed chambers of the manufacturing apparatuses described above. The reason that the synthetic resin adhesive M1 flows out can be because, for example, kinetic energy of the rotary motion of the rotor acts on the fragments or because the exhaust gas flows back from the vacuum pump to the chamber. This flow of the fragments similarly occurs when mass adding means other than the synthetic resin adhesive M1 is employed as a weight to achieve the balance.

Especially when a balancing groove D is formed on the inner circumferential surface of the rotor 6 and the synthetic resin adhesive M1 is applied to the groove D in the specific configuration of the balancing portion BC of the rotor 6 as shown in FIG. 9 of the present application, the fragments of the synthetic resin adhesive M1 that are caused by corrosion might accumulate in the groove D instead of immediately falling off the balancing groove D. Therefore, when the fragments of the synthetic resin adhesive M1 that are created by experimental corrosion accumulate in the groove D in an anti-corrosion test of the vacuum pump, such fragments cannot be observed during the anti-corrosion test, and as a result the fragments flow out from the delivered vacuum pump to the upstream apparatus.

In addition, when applying the synthetic resin adhesive M1 to the balancing groove D described above, first, the synthetic resin adhesive M1 is applied first to a tip end of a rod-like tool T, and then the tip end of this tool T is inserted into a gap L between a rotor shaft 5 and the rotor 6, as shown in FIG. 10 of the present application (see the tool T indicated by the double broken line in FIG. 10). In so doing, due to the predetermined depth of the balancing groove D from the inner circumferential surface of the rotor 6, the synthetic resin adhesive M1 cannot be applied to the groove D unless the tool T inserted as described above is inclined at a predetermined angle with respect to the inner circumferential surface of the rotor 6 (see the tool T indicated by the solid line in FIG. 10), resulting in a contact/interference of the tilted tool T with the rotor shaft 5, hence poor balancing workability. Especially when the vacuum pump is small, the tilted tool T easily comes into contact with or interferes with the rotor shaft 5 due to the narrow space between the rotor shaft 5 and the rotor 6, resulting in poorer balancing workability.

SUMMARY

The present invention was contrived in order to solve these problems, and an object thereof is to provide a rotor favorable for improving evacuation performance of a vacuum pump and preventing a fragment from falling off a balancing portion, and a vacuum pump equipped with this rotor. Another object of the present invention is to provide a rotor favorable for discharging and discovering a fragment early if there is a fragment falling off the balancing portion and for improving the balancing workability, as well as a vacuum pump equipped with the rotor.

In order to accomplish these objects, a first invention is a rotor of a vacuum pump for exhausting gas from a chamber, the rotor having: first and second cylindrical bodies; and a connecting portion that connects end portions of the cylindrical bodies together, wherein the first cylindrical body has a plurality of rotor blades on an outer circumferential surface thereof, and configures a blade exhaust portion when the rotor blades are arranged along an axial center of the vacuum pump alternately with a plurality of stator blades, the second cylindrical body configures a threaded groove exhaust portion when a threaded groove exhaust flow passage is formed at least on an inner circumference of the second cylindrical body, and a balancing portion for the rotor is provided on an inner circumferential surface of the first cylindrical body or the connecting portion, the balancing portion being provided with mass adding means.

In the first invention, the balancing portion may have an inner diameter larger than that of the first cylindrical body, the inner diameter of the balancing portion being constant or becoming greater toward a lower portion thereof.

In the first invention, the balancing portion may be formed into a tapered shape in which a part thereof close to the connecting portion is deep and a part thereof away from the connecting portion is shallow.

In the first invention, the balancing portion may be formed into a stepped shape in which a step portion is provided in the middle, and with the step portion as a boundary, a region of the balancing portion that is close to the connecting portion is deep and a region thereof away from the connecting portion is shallow.

In the first invention, the connecting portion may function as a non-contact type seal for preventing the gas from flowing back toward the inner circumferential surface of the first cylindrical body or the inner circumferential surface of the connecting portion when the connecting portion and a stator portion face each other with a predetermined gap therebetween.

A second present invention is a rotor of a vacuum pump for exhausting gas from a chamber, the rotor having: first and second cylindrical bodies; and a connecting portion that connects end portions of the cylindrical bodies together, wherein the first cylindrical body has a plurality of rotor blades on an outer circumferential surface thereof, and configures a blade exhaust portion when the rotor blades are arranged along an axial center of the vacuum pump alternately with a plurality of stator blades, the second cylindrical body configures a threaded groove exhaust portion when a threaded groove exhaust flow passage is formed at least on an inner circumference of the second cylindrical body, and the connecting portion functions as a non-contact type seal for preventing the gas from flowing back toward an inner circumferential surface of the first cylindrical body or an inner circumferential surface of the connecting portion when the connecting portion and a stator portion face each other with a predetermined gap therebetween.

In the first and second inventions, the predetermined gap may be 0.5 mm to 3.0 mm, and more preferably 1.0 mm to 1.5 mm.

Furthermore, a third invention is a rotor of a vacuum pump for exhausting gas from a chamber, the rotor having: first and second cylindrical bodies; and a connecting portion that connects end portions of the cylindrical bodies together, wherein the first cylindrical body has a plurality of rotor blades on an outer circumferential surface thereof, and configures a blade exhaust portion when the rotor blades are arranged along an axial center of the vacuum pump alternately with a plurality of stator blades, the second cylindrical body configures a threaded groove exhaust portion when a threaded groove exhaust flow passage is formed at least on an inner circumference of the second cylindrical body, the connecting portion is configured by an annular plate provided integrally with a lower end of the first cylindrical body and an annular convex portion provided integrally with an outer circumferential portion of the annular plate, the first and second cylindrical bodies are connected to each other by fitting the second cylindrical body into the annular convex portion, and an inner circumferential surface of the convex portion is formed as a balancing portion of the rotor, the balancing portion being provided with anti-corrosion mass adding means.

In the first, second or third invention, the second cylindrical body can be made of FRP.

The vacuum pump according to the present invention has the rotor of a vacuum pump according to the first, second or third invention.

According to the first invention, the inner circumferential surface of the first cylindrical body or of the connecting portion is provided with the balancing portion, and this balancing portion is provided with the mass adding means, as described above. Therefore, the threaded groove exhaust flow passage is not formed on the inner circumference of the first cylindrical body or of the connecting portion, improving the evacuation performance of the vacuum pump without an impact of the balancing portion on the threaded groove exhaust portion, or, more specifically, without having the effective thread length of the threaded groove exhaust portion shortened by the presence of the balancing portion. In addition, the mass adding means provided in the balancing portion is not directly exposed to the corrosive gas, preventing problems such as the occurrence of fragments from the mass adding means due to corrosion thereof.

Especially in the first invention, the balancing portion has an inner diameter larger than that of the first cylindrical body, the inner diameter of the balancing portion being constant or becoming greater toward a lower portion thereof. Due to this configuration employed in the first invention, the lower portion of the balancing portion is opened downward. Thus, even when, for any reason, part of the mass adding means of the balancing portion falls off in fragments, these fragments fall smoothly downward from the lower portion of the balancing portion that is opened as described above, and then are discharged to the outside of the vacuum pump along with the gas discharged from the vacuum pump. Consequently, in a case where such fragments are generated during the anti-corrosion test of the vacuum pump, early discharge and discovery of such fragments can be realized, preventing the fragments from flowing from the delivered vacuum pump to a device located upstream of the vacuum pump.

In a case where the lower portion of the balancing portion is opened downward as described above, when, for example, a synthetic resin adhesive is used as the mass adding means, the synthetic resin adhesive can be applied to a tip end of a tool positioned substantially parallel to the inner circumferential surface of the rotor, and then the tip end of this tool can be inserted into the balancing portion from the opened lower portion thereof while moving the tool in parallel, thereby applying the synthetic resin adhesive (the mass adding means) to a predetermined position of the balancing portion. In so doing, the tool does not need to be tilted, which can prevent the tool and the rotor shaft from coming into contact with each other or interfering with each other and improve balancing workability.

According to the second invention, the phenomenon in which the corrosive gas flows back toward the inner circumferential surface of the first cylindrical body or the inner circumferential surface of the connecting portion is prevented by means of the non-contact seal, reducing the chance that the inner circumferential surface of the first cylindrical body or the inner circumferential surface of the connecting portion is exposed to the corrosive gas. Therefore, for example, in a case where the inner circumferential surface of the first cylindrical body or the inner circumferential surface of the connecting portion is configured as the balancing portion and the mass adding means is provided to the balancing portion, the occurrence of fragments due to corrosion of the mass adding means can be prevented more effectively.

The third invention employs a configuration in which the inner circumferential surface of the convex portion is configured as the balancing portion of the rotor and the anti-corrosion mass adding means is provided to the balancing portion, as described above. Because a threaded groove for configuring the threaded-groove exhaust flow passage is not formed on the inner circumferential surface of the convex portion, the evacuation performance of the vacuum pump can be improved without an impact of the balancing portion of the threaded groove exhaust portion due to the presence of the mass adding means provided on the inner circumferential surface of the convex portion, or, more specifically, without having the effective thread length of the threaded groove exhaust portion shortened by the presence of the balancing portion.

In addition, the third invention employs the anti-corrosion mass adding means. Thus, even when the inner circumference of the convex portion provided with the mass adding means is configured as a flow passage communicated with the threaded groove exhaust flow passage, not only is it possible to prevent corrosion of the mass adding means by the corrosive gas inside this flow passage, but also fracture of the mass adding means due to corrosion can be avoided, preventing fragments from falling off the balancing portion. Furthermore, the possibility that such fragments flow out to a device located downstream of the vacuum pump along with the gas discharged from the vacuum pump can also be reduced significantly.

In the third invention, the lower portion of the inner circumferential surface of the convex portion is opened downward. For this reason, even when, for any reason, part of the mass adding means provided on the inner circumferential surface of the convex portion falls off in fragments, these fragments do not accumulate anywhere but fall immediately and smoothly downward from the opened portion of the inner circumferential surface of the convex portion (the lower portion of the inner circumferential surface of the convex portion), and are discharged to the outside of the vacuum pump along with the gas exhausted from the vacuum pump. Consequently, in a case where such fragments are generated during the anti-corrosion test of the vacuum pump, early discharge and discovery of such fragments can be realized, preventing the fragments from flowing from the delivered vacuum pump to a device located upstream of the vacuum pump.

In the third invention, the lower portion of the inner circumferential surface of the convex portion is opened downward, as described above. When, for example, a synthetic resin adhesive is used as the mass adding means, the synthetic resin adhesive can be applied to a tip end of a tool positioned substantially parallel to the inner circumferential surface of the rotor, and then the tip end of this tool can be inserted into the inner circumferential surface of the convex portion from the opened portion thereof while moving the tool in parallel (the lower portion of the inner circumferential surface of the convex portion), thereby applying the synthetic resin adhesive (the mass adding means) to a predetermined position of the inner circumferential surface of the convex portion. In so doing, the tool does not need to be tilted, which can prevent the tool and the rotor shaft from coming into contact with each other or interfering with each other and improve balancing workability.

BRIEF DESCRIPTION OF THE DRAWINGS

FIG. 4A is a cross-sectional diagram of a vacuum pump (threaded groove pump fold flow type) according to a second embodiment of the present invention;

FIG. 4B is an enlarged view showing a B portion shown in FIG. 4A;

FIG. 8A is a cross-sectional diagram of a vacuum pump (threaded groove pump parallel flow type) according to sixth embodiment of the present invention;

FIG. 8B is an enlarged view showing a B portion shown in FIG. 8A;

FIG. 9 is a cross-sectional diagram of a conventional vacuum pump (threaded groove pump parallel flow type) to which the conventional balancing portion disclosed in Japanese Patent No. 3974772 is applied; and FIG. 10 is an explanatory diagram illustrating how to balance a rotor of the conventional vacuum pump shown in FIG. 9.

DETAILED DESCRIPTION

Figure 1:
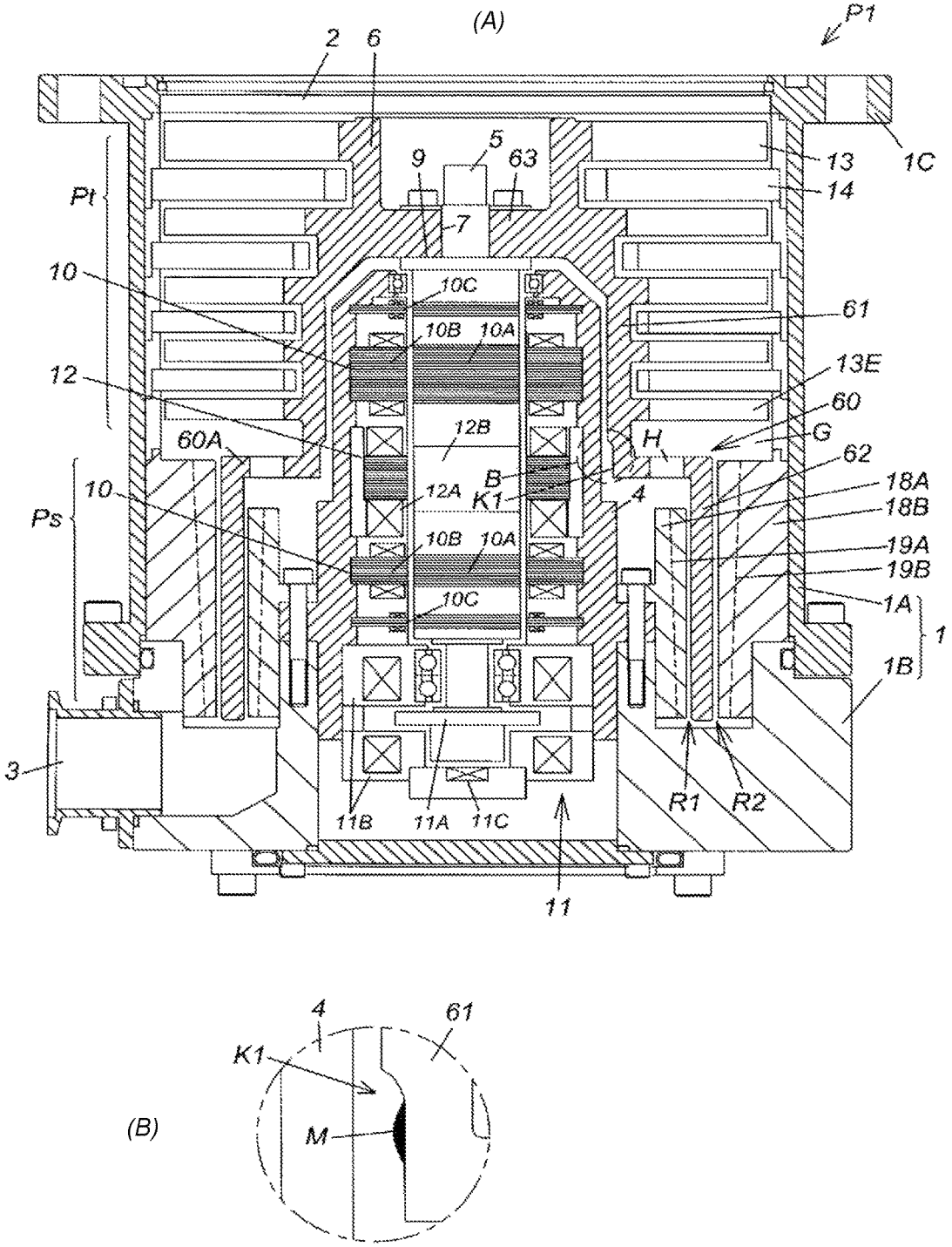
FIG. 1A is a cross-sectional diagram of a vacuum pump (threaded groove pump parallel flow type) according to a first embodiment of the present invention.
FIG. 1B is an enlarged view showing a B portion shown in FIG. 1A.

The best modes for implementing the present invention are described hereinafter in detail with reference to the accompanying drawings.

FIG. 1A is a cross-sectional diagram showing a vacuum pump (threaded groove pump parallel flow type) according to a first embodiment of the present invention, and FIG. 1B an enlarged view showing a B portion shown in FIG. 1A.

A vacuum pump P1 shown in FIG. 1A is used as, for example, gas exhaust means of a process chamber or other closed chambers of a semiconductor manufacturing apparatus, a flat panel display manufacturing apparatus, or a solar panel manufacturing apparatus. This vacuum pump has, in an exterior case 1 thereof, a blade exhaust portion Pt for exhausting a gas by means of rotor blades 13 and stator blades 14, a threaded groove exhaust portion Ps for exhausting the gas by means of threaded grooves 19A, 19B, and a drive system for driving these portions.

The exterior case 1 is in the shape of a bottomed cylinder having a cylindrical pump case 1A and a cylindrical pump base 1B with a bottom connected integrally with each other by a bolt in a cylindrical axial direction. A gas inlet port 2 is formed and opened at the upper end side of the pump case 1A, and a lower end portion-side surface of the pump base 1B is provided with a gas outlet port 3.

The gas inlet port 2 is connected to, for example, a closed chamber, not shown, which becomes high vacuum, such as a process chamber of a semiconductor manufacturing apparatus, by a bolt, not shown, which is provided in a flange 1C at an upper edge of the pump case 1A. The gas outlet port 3 is connected communicably to an auxiliary pump, not shown.

A cylindrical stator column 4 incorporating various electrical components is provided at the middle of the pump case 1A. The stator column 4 is provided upright as a stator portion in such a manner that a lower end thereof is screwed and fixed onto the pump base 1B.

A rotor shaft 5 is provided on the inside of the stator column 4, wherein the rotor shaft 5 has an upper end portion thereof facing the gas inlet port 2 and a lower end portion of the same facing the pump base 1B. The upper end portion of the rotor shaft 5 protrudes upward from a cylinder upper end surface of the stator column 4.

The rotor shaft 5 is rotatably supported in radial and axial directions thereof by radial magnetic bearings 10 and axial magnetic bearings 11, and is driven to rotate by a drive motor 12.

The drive motor 12 is configured by a stator 12A and a rotator 12B and provided in the vicinity of the middle of the rotor shaft 5. The stator 12A of the drive motor 12 is located on the inside of the stator column 4, while the rotator 12B of the drive motor 12 is mounted integrally with an outer circumferential surface of the rotor shaft 5.

The radial magnetic bearings 10 are provided in a total of two pairs on the upper side and lower side of the drive motor 12 respectively, and the axial magnetic bearings 11 are provided in a pair at the lower end portion side of the rotor shaft 5.

The two pairs of radial magnetic bearings 10 are each configured by a radial electromagnetic target 10A attached to the outer circumferential surface of the rotor shaft 5, a plurality of radial electromagnets 10B installed on an inner side surface of the stator column 4 so as to oppose the radial electromagnetic target 10A, and a radial displacement sensor 10C. The radial electromagnetic target 10A is formed from laminated steel panels formed by stacking highly permeable steel panels, and the radial electromagnets 10B suction the rotor shaft 5 in the radial direction by a magnetic force of the radial electromagnetic target 10A. The radial displacement sensor 10C detects a radial displacement of the rotor shaft 5. Based on a detection value obtained by the radial displacement sensor 10C (the radial displacement of the rotor shaft 5), excitation currents of the radial electromagnets 10B are controlled, whereby the rotor shaft 5 is supported in a floating manner at a predetermined position in the radial direction by the magnetic force.

The axial magnetic bearings 11 are each configured by a disc-shaped armature disc 11A attached to an outer circumference of the lower end portion of the rotor shaft 5, axial electromagnets 11B that face each other vertically with the armature disc 11A therebetween, and an axial displacement sensor 11C that is positioned slightly away from a lower end surface of the rotor shaft 5. The armature disc 11A is made of a highly permeable material, and the upper and lower axial electromagnets 11B suction the armature disc 11A in a vertical direction by magnetic force. The axial displacement sensor 11C detects an axial displacement of the rotor shaft 5. Based on a detection value obtained by the axial displacement sensor 11C (the axial displacement of the rotor shaft 5), excitation currents of the upper and lower axial electromagnets 11B are controlled, whereby the rotor shaft 5 is supported in a floating manner at a predetermined position in the axial direction by the magnetic force.

The rotor 6 is provided on the outside of the stator column 4. The rotor 6 is in the shape of a cylinder surrounding the outer circumference of the stator column 4, and is configured to connect two cylindrical bodies of different diameters (a first cylindrical body 61 and a second cylindrical body 62) in a cylindrical axial direction thereof by means of the connecting portion 60 (an annular plate 60A, to be precise) located in substantially the middle of the rotor 6. Note that the rotor 6 of the vacuum pump shown in FIG. 1A is cut out of a single aluminum alloy lump; thus, the first cylindrical body 61, second cylindrical body 62, connecting portion 60, and an end member 63 described hereinafter, which configure the rotor 6, are formed into a single component.

An upper end of the first cylindrical body 61 is provided integrally with the end member 63 to configure an upper end surface of the first cylindrical body 61. The rotor 6 is integrated with the rotor shaft 5 by the end member 63. As a structural example for this integration, in the vacuum pump P1 shown in FIG. 1A a boss hole 7 is provided at the center of the end member 63 and a step-like shoulder portion (referred to as "rotor shaft shoulder portion 9" hereinafter) is formed on the outer circumference of the upper end portion of the rotor shaft 5. The rotor 6 and the rotor shaft 5 are integrated by fitting a tip end portion of the rotor shaft 5, located above the rotor shaft shoulder portion 9, into the boss hole 7 of the end member 63 and fixing the end member 63 and the rotor shaft shoulder portion 9 to each other with a bolt.

Furthermore, the rotor 6 is supported so as to be able to rotate about an axial center (the rotor shaft 5) of the rotor shaft 5 by the radial magnetic bearings 10 and the axial magnetic bearings 11. Therefore, in the vacuum pump P1 shown in FIG. 1A, the rotor shaft 5, the radial magnetic bearings 10 and the axial magnetic bearings 11 function as supporting means for supporting the rotor 6 in an axially rotatable manner. Because the rotor 6 rotates together with the rotor shaft 5, the drive motor 12 that drives the rotor shaft 5 to rotate functions as driving means for driving the rotor 6 to rotate.

In the vacuum pump P1 shown in FIG. 1A, the section upstream of substantially the middle of the rotor 6 (the connecting portion 60, to be precise) (the region between substantially the middle of the rotor 6 and the end portion of the rotor 6 at the gas inlet port 2 side) functions as the blade exhaust portion Pt. The blade exhaust portion P1 is described hereinafter in detail.

The plurality of rotor blades 13 are provided integrally with an outer circumferential surface of the rotor 6 at the upstream side of substantially the middle of the rotor 6, i.e., an outer circumferential surface of the first cylindrical body 61 configuring the rotor 6. These rotor blades 13 are arranged radially around the central axis of rotation of the rotor 6 (the rotor shaft 5) or the axial center of the exterior case 1 (referred to as "vacuum pump axial center", hereinafter).

On the other hand, the plurality of stator blades 14 are provided on the inner circumferential surface of the pump case 1A. These stator blades 14 too are arranged radially around the vacuum pump axial center.

In the vacuum pump P1 shown in FIG. 1A, the rotor blades 13 and stator blades 14 are arranged radially and alternately into steps along the vacuum pump axial center as described above, configuring the blade exhaust portion Pt of the vacuum pump P1.

In other words, in the vacuum pump P1 shown in FIG. 1A, the first cylindrical body 61 configuring the rotor 6 has the plurality of rotor blades 13 on the outer circumferential surface thereof, wherein these rotor blades 13 are arranged to alternate with the stator blades 14 along the vacuum pump axial center, configuring the blade exhaust portion Pt of the vacuum pump P1.

It should be noted that each of the rotor blades 13 is a blade-like cut product that is obtained by cutting together with an outer-diameter machined portion of the rotor 6, and is inclined at an angle appropriate for exhausting gaseous molecules. Each of the stator blades 14 is also inclined at an angle appropriate for exhausting the gaseous molecules.

In the blade exhaust portion Pt configured as described above, the drive motor 12 is activated to integrally rotate the rotor shaft 5, rotor 6, and plurality of rotor blades 13 at high speed, wherein the top rotor blade 13 applies a downward momentum to gaseous molecules entering from the gas inlet port 2. The gaseous molecules applied with this downward momentum are sent toward the next rotor blade 13 by the stator blades 14. The operation for applying a momentum to the gaseous molecules and the operation for sending the resultant gaseous molecules are repeated multiple times, whereby the gaseous molecules at the gas inlet port 2 side are exhausted toward the downstream of the rotor 6 in such a manner that the gaseous molecules are shifted from one blade to the other.

In the vacuum pump P1 shown in FIG. 1A, the section downstream of substantially the middle of the rotor 6 (the connecting portion 60, to be precise) (the region between substantially the middle of the rotor 6 and the end portion of the rotor 6 at the gas outlet port 3 side) functions as the threaded groove exhaust portion Ps. The threaded groove exhaust portion Ps is described hereinafter in detail.

The section of the rotor 6 that is located downstream of substantially middle of the rotor 6, i.e., the second cylindrical body 62 configuring the rotor 6, rotates as a rotating member of the threaded groove exhaust portion Ps, and is configured to be inserted/contained between double, inner and outer cylindrical threaded groove exhaust portion stators 18A, 18B of the threaded groove exhaust portion Ps with a predetermined gap therebetween.

Of the inner and outer double, cylindrical threaded groove exhaust portion stators 18A, 18B, the threaded groove exhaust portion stator 18A on the inside (referred to as "inner threaded groove exhaust portion stator 18A", hereinafter) is a cylindrical stator portion that is placed in such a manner that an outer circumferential surface thereof faces the inner circumferential surface of the second cylindrical body 62, and is surrounded by the inner circumference of the second cylindrical body 62.

The threaded groove exhaust portion stator 18B on the outside (referred to as "outer threaded groove exhaust portion stator 18B", hereinafter), on the other hand, is a cylindrical stator portion that is placed in such a manner that an inner circumferential surface thereof faces the outer circumferential surface of the second cylindrical body 62, and surrounds the outer circumference of the second cylindrical body 62.

The threaded groove 19A that tapers downward is formed in an outer circumferential portion of the inner threaded groove exhaust portion stator 18A. The threaded groove 19A is carved into a spiral from an upper end of the inner threaded groove exhaust portion stator 18A to a lower end of the same, and a threaded groove exhaust flow passage is provided on the inner circumference of the second cylindrical body 62 by this threaded groove 19A (referred to as "inner threaded groove exhaust flow passage R1", hereinafter). A lower end portion of the inner threaded groove exhaust portion stator 18A is supported by the pump base 1B.

The threaded groove 19B, similar to the threaded groove 19A, is formed in the inner circumferential portion of the outer threaded groove exhaust portion stator 18B. A threaded groove exhaust flow passage is provided on the outer circumference of the second cylindrical body 62 by this threaded groove 19B (referred to as "outer threaded groove exhaust flow passage R2", hereinafter). A lower end portion of the outer threaded groove exhaust portion stator 18B is also supported by the pump base 1B.

In other words, in the vacuum pump P1 shown in FIG. 1A, the second cylindrical body 62 configuring the rotor 6 configures the threaded groove exhaust portion Ps of the vacuum pump P1 when the spiral threaded groove exhaust flow passage (the inner threaded groove exhaust flow passage R1) is formed at least between the inner circumferential surface of the second cylindrical body 62 and the outer circumferential surface of the stator portion (the inner threaded groove exhaust portion stator 18A) facing the foregoing inner circumferential surface.

Although not shown, the inner threaded groove exhaust flow passage R1 or the outer threaded groove exhaust flow passage R2 may be configured by forming the threaded grooves 19A, 19B on the inner circumferential surface or outer circumferential surface or both surfaces of the second cylindrical body 62.

In the threaded groove exhaust portion Ps, the gas is transferred while being compressed by the drag effect in the threaded groove 19A and the inner circumferential surface of the second cylindrical body 62 or the drag effect in the threaded groove 19B and the outer circumferential surface of the second cylindrical body 62. Therefore, the depth of the threaded groove 19A becomes the deepest at the upstream inlet side of the inner threaded groove exhaust flow passage R1 (a flow passage opening end in the vicinity of the gas inlet port 2) and the shallowest at a downstream outlet side of the same (a flow passage opening end in the vicinity of the gas outlet port 3). The same applies to the threaded groove 19B.

The upstream inlet of the outer threaded groove exhaust flow passage R2 is communicated with a gap between the lowest rotor blade 13E of the plurality of rotor blades 13 arranged into steps and an upstream end of a communication opening portion H described hereinafter (referred to as "final gap G", hereinafter). A downstream outlet of the flow passage R2 is communicated with the gas outlet port 3.

The upstream inlet of the inner threaded groove exhaust flow passage R1 is opened to the inner circumferential surface of the rotor 6 at substantially the middle of the rotor 6 (the inner surface of the connecting portion 60, to be precise), and the downstream outlet of the flow passage R1 joins the downstream outlet of the outer threaded groove exhaust flow passage R2 and is communicated with the gas outlet port 3.

The communication opening portion H is provided substantially in the middle of the rotor 6. The communication opening portion H is formed in such a manner as to pass through the front and rear surfaces of the rotor 6, thereby guiding some of the gas on the outer circumference of the rotor 6 to the inner threaded groove exhaust flow passage R1. The communication opening portion H that functions in this manner may be formed in such a manner as to, for example, pass through the inner and outer surfaces of the connecting portion 60, as shown in FIG. 1A. Also, the vacuum pump P1 shown in FIG. 1A is provided with a plurality of the communication opening portions H, which are arranged point-symmetrically with respect to the vacuum pump axial center, so that the center of gravity of the rotor 6 does not easily shift in the radial direction, enabling easy correction of the balance of the rotor 6.

The gaseous molecules, which reach the upstream inlet of the outer threaded groove exhaust flow passage R2 or the final gap G by being transferred by the exhaust operation of the blade exhaust portion Pt described above, are transferred from the outer threaded groove exhaust flow passage R2 or the communication opening portions H to the inner threaded groove exhaust flow passage R1. The transferred gaseous molecules are transferred toward the gas outlet port 3 by being compressed from a transitional flow into a viscous flow by the effect of the rotation of the rotor 6, i.e., the drag effect of the outer circumferential surface of the second cylindrical body 62 and the threaded groove 19B or the drag effect of the inner circumferential surface of the second cylindrical body 62 and the threaded groove 19A. The gaseous molecules are eventually exhausted to the outside through an auxiliary pump, not shown.

In the vacuum pump P1 shown in FIG. 1A, the balancing portion K1 of the rotor 6 is provided on the inner circumferential surface of the first cylindrical body 61 or connecting portion 60, and mass adding means M shown in FIG. 1B is provided to the balancing portion K1 as sort of a weight for balancing the rotor 6.

The balancing portion K1 is configured to have an inner diameter larger than that of the first cylindrical body 61 by cutting the inner circumferential surface of the first cylindrical body 61, starting from the connecting portion 60, at a predetermined depth, as shown in FIGS. 1A and 1B, wherein the inner diameter of the balancing portion K1 is constant toward the lower portion thereof. In a case where the inner diameter of the balancing portion K1 is larger than that of the first cylindrical body 61, the balancing portion K1 may be configured in such a manner that the inner diameter thereof becomes constant or greater toward the lower portion thereof.

It is preferred that the balancing portion K1 be in an annular shape throughout the entire circumferential direction of the inner circumferential surface of the first cylindrical body 61 as shown in FIG. 1A. Such a configuration can balance the rotor 6 by means of the mass adding means M regardless of the circumferential position thereof, increases the degree of freedom for balancing the rotor, and prevents the center of gravity of the rotor 6 from shifting easily in the radial direction by the partial removal of the first cylindrical body 61 due to the balancing portion K1 obtained by cutting out a part of the first cylindrical body 61, enabling easy correction of the balance of the rotor 6.

In the vacuum pump P1 shown in FIG. 1A, the length of the balancing portion K1 is equal to or less than half a reference, the axial length of the first cylindrical body 61; however, the length of the balancing portion K1 is not limited thereto. Although not shown, the length of the balancing portion K1 may be equal to or greater than half the reference.

Figure 2:
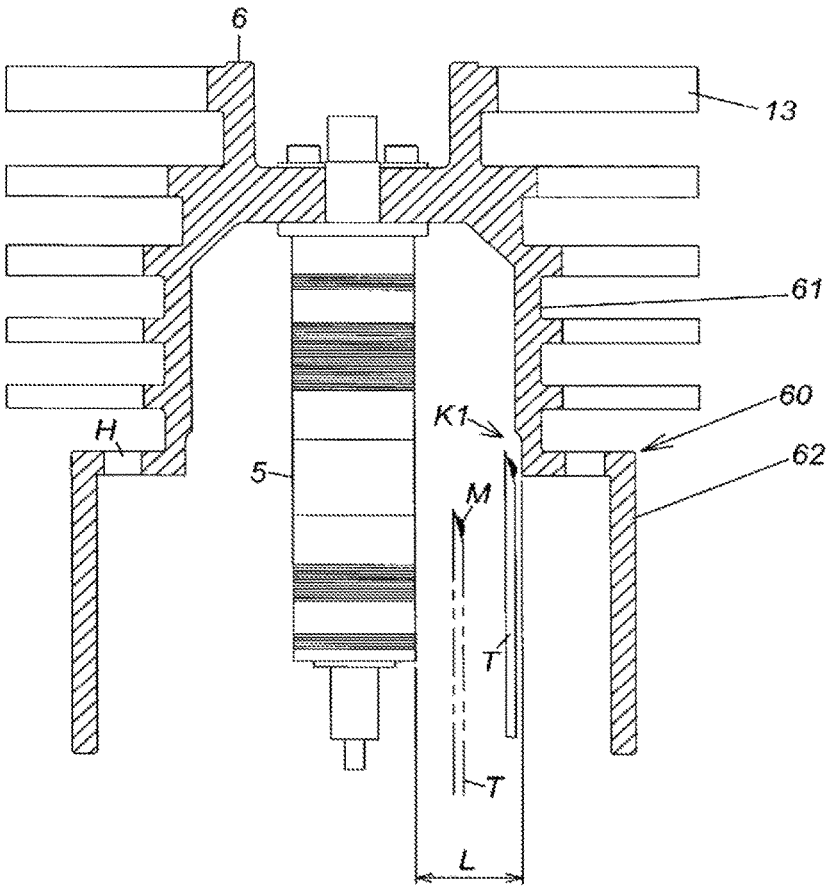
FIG. 2 is an explanatory diagram showing how to balance a rotor with a balancing portion shown in FIG. 1.

FIG. 2 is an explanatory diagram showing how to balance the rotor 6 with the balancing portion K1 shown in FIG. 1. Because the balancing portion K1 shown in FIG. 1 is obtained by cutting the first cylindrical body 61 starting from the connecting portion 60 as described above, the lower portion of the balancing portion K1 (at the connecting portion 60 side) is opened downward. Therefore, when, for example, a synthetic resin adhesive described below is used as the mass adding means M, the rotor 6 can be balanced using the balancing method shown in FIG. 2.

The balancing method shown in FIG. 2 applies the synthetic resin adhesive (the mass adding means M) to a tip end of the rod-like tool T in advance, and places this tool T substantially parallel to the inner circumferential surface of the rotor 6. In this position, the tip end of the tool T is inserted between the rotor shaft 5 and the rotor 6 (see the tool T indicated by the double broken line in FIG. 2). Then, while moving the inserted tool T parallel as described above, the tip end of the tool T is inserted into the balancing portion K1 from the opened lower portion of the balancing portion K1 (see the tool T indicated by the solid line in FIG. 2), whereby the synthetic resin adhesive (the mass adding means M) is applied to a predetermined position of the balancing portion K1.

Figure 3:
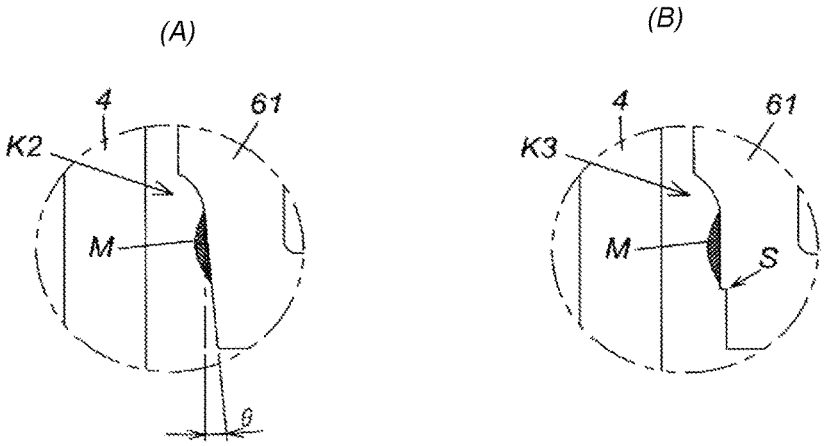
FIG. 3A is an explanatory diagram showing a modification of the shape of a cutout portion K1 shown in FIG. 1A.
FIG. 3B is an explanatory diagram showing a modification of the shape of the cutout portion K1 shown in FIG. 1A.

FIGS. 3A and 3B are explanatory diagrams each showing a modification of the shape of the balancing portion K1 shown in FIG. 1A. A balancing portion K2 shown in FIG. 3A is formed into a tapered shape in which a part thereof close to especially the connecting portion 60 is deep and a part thereof away from the connecting portion 60 is shallow. A balancing portion K3 shown in FIG. 3B is formed into a stepped shape in which a step portion S is provided in the middle, and with the step portion S as a boundary, a region of the balancing portion K3 that is close to the connecting portion 60 is deep and a region thereof away from the connecting portion 60 is shallow. The balancing portion K2 in a tapered shape and the balancing portion K3 with the step portion S can be employed as the balancing portion K1 shown in FIG. 1A. Although not shown, if necessary, a balancing portion with a combination of such tapered shape and step portion can be employed as the balancing portion K1 shown in FIG. 1A.

A synthetic resin adhesive made of, for example, an epoxy resin, silicone resin, polyamide resin or the like can be applied as the mass adding means M to the balancing portion K1, K2, K3 into approximately 1 mm, and this synthetic resin adhesive can be hardened at room temperature or with heat. In so doing, a method for, for example, containing metal powder that is denser than the synthetic resin adhesive in the synthetic resin adhesive may be employed as a method for reducing the amount of synthetic resin adhesive to be applied. Examples of the metal powder include SUS powder, ceramic fine particles or ceramic short fibers of aluminum oxide (Al203), silicon oxide (SiO2), chromium oxide (Cr2O3), or other metallic oxides.

According to the vacuum pump P1 of the first embodiment described above, the balancing portion K1, K2, K3 of the rotor 6 is provided on the inner circumferential surface of the first cylindrical body 61 or connecting portion 60, and the mass adding means M is provided in the balancing portion K1, K2, K3. Because the inner circumference of the first cylindrical body 61 or connecting portion 60 is not provided with a threaded groove exhaust flow passage, the evacuation performance of the vacuum pump P can be improved without an impact of the balancing portion K1, K2, K3 on the threaded groove exhaust portion Ps, or, more specifically, without having the effective thread length of the threaded groove exhaust portion Ps shortened by the presence of the balancing portion K1, K2, K3. In addition, the mass adding means M provided in the balancing portion K1, K2, K3 is not directly exposed to the corrosive gas, preventing problems such as the occurrence of fragments from the mass adding means M due to corrosion thereof.

In addition, in the specific configuration of the balancing portion K1, K2, K3 of the vacuum pump P1 according to the first embodiment, the balancing portion K1, K2, K3 has an inner diameter larger than that of the first cylindrical body 61, the inner diameter becoming constant or greater toward the lower portion thereof. Therefore, the lower portion of the balancing portion K1, K2, K3 (at the connecting portion 60 side) is opened downward. Thus, even when, for any reason, part of the mass adding means M of the balancing portion K1, K2, K3 falls off in fragments, these fragments fall smoothly downward from the lower portion of the balancing portion K1, K2, K3 that is opened as described above, and then are discharged to the outside of the vacuum pump P along with the gas exhausted from the vacuum pump P. Consequently, in a case where such fragments are generated during the anti-corrosion test of the vacuum pump, early discharge and discovery of such fragments can be realized, preventing the fragments from flowing from the delivered vacuum pump to a device located upstream of the vacuum pump.

Furthermore, in a case where the lower portion of the balancing portion K1, K2, K3 is opened downward as described above, when, for example, a synthetic resin adhesive is used as the mass adding means M, the synthetic resin adhesive can be applied to a tip end of a tool positioned substantially parallel to the inner circumferential surface of the rotor 6, and then the tip end of this tool can be inserted into the balancing portion K1, K2, K3 from the opened lower portion thereof while moving the tool in parallel, thereby applying the synthetic resin adhesive (the mass adding means) to a predetermined position of the balancing portion K1, K2, K3. In so doing, the tool does not need to be tilted, which can prevent the tool and the rotor shaft from coming into contact with each other or interfering with each other and improve balancing workability.

FIG. 4A is a cross-sectional diagram of a vacuum pump (threaded groove pump fold flow type) according to a second embodiment of the present invention. FIG. 4B is an enlarged view showing a B portion shown in FIG. 4A.

Unlike the vacuum pump P1 shown in FIG. 1A in which the gas flows parallel to the inner and outer circumferences of substantially the lower half of the rotor 6 (the second cylindrical body 62) (threaded groove pump parallel flow type), a vacuum pump P2 shown in FIG. 4A is of a different type.

In other words, as shown by the arrow R1-R2 in FIG. 4A, the vacuum pump P2 shown in FIG. 4A is configured to allow the gas to flow in directions opposite to each other on the inner circumference side and the outer circumference side of substantially the lower half of the rotor 6 by vertically inverting the direction of the gas flowing at the lower end portion of the rotor 6 (the lower end portion of the second cylindrical body 62, to be precise) (threaded groove pump fold flow type). The basic configuration of the vacuum pump P2 other than this configuration is the same as that of the vacuum pump P1 shown in FIG. 1A. Thus, in FIG. 4A, the same reference numerals are used to indicate the members same as those shown in FIG. 1A, and the detailed descriptions thereof are omitted accordingly.

The balancing portions K1, K2 and K3 shown in FIGS. 1A and 1B and FIGS. 3A and 3B described in the first embodiment of the present invention can be applied to the vacuum pump P2 of the threaded groove pump fold flow type shown in FIG. 4A.

Figure 5:
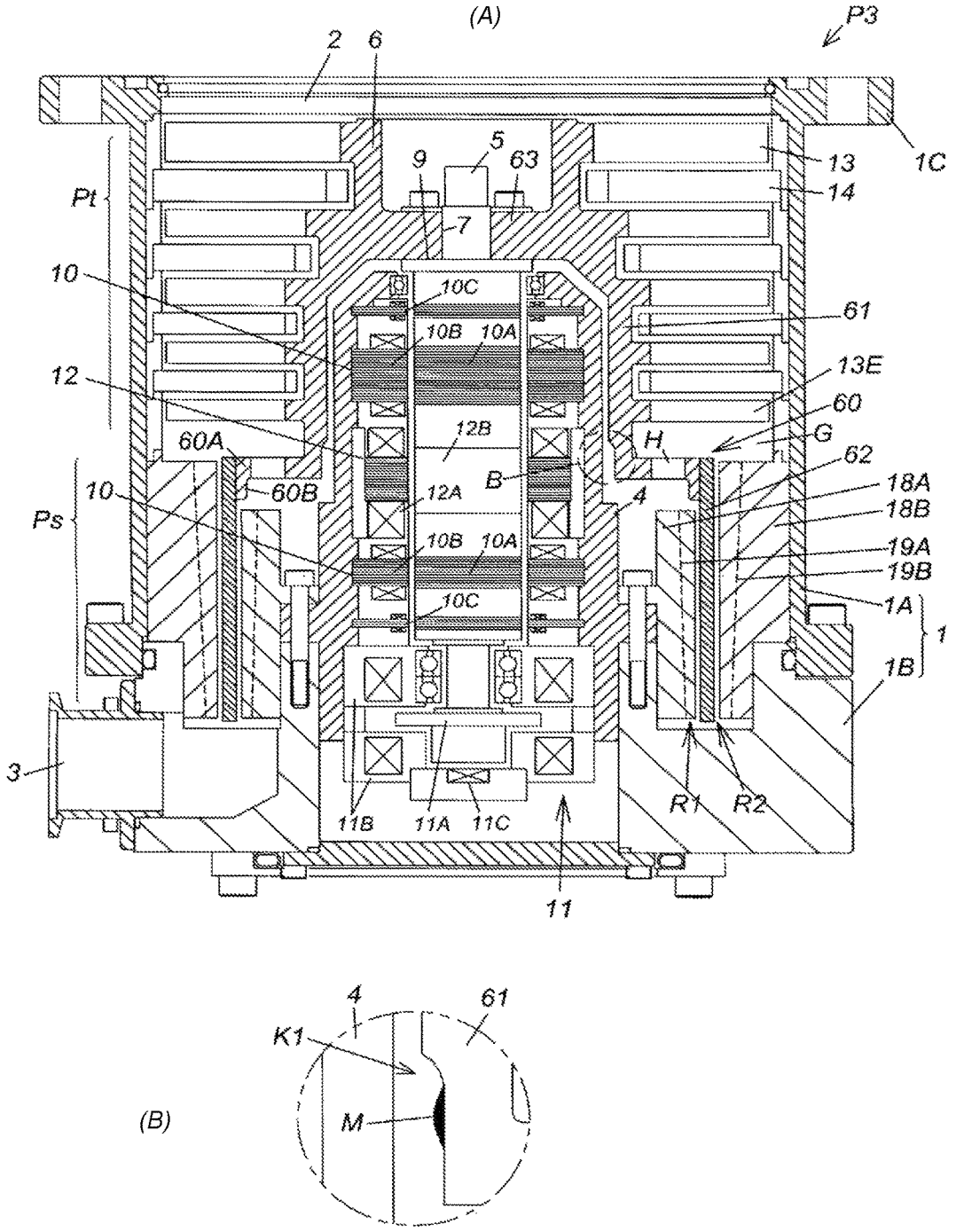
FIG. 5A is a cross-sectional diagram of a vacuum pump (threaded groove pump parallel flow type) according to a third embodiment of the present invention.
FIG. 5B is an enlarged view showing a B portion shown in FIG. 5A.

FIG. 5A is a cross-sectional diagram of a vacuum pump (threaded groove pump parallel flow type, and partial resin rotor type) according to a third embodiment of the present invention. FIG. 5B is an enlarged view showing a B portion shown in FIG. 5A.

In a vacuum pump P3 shown in FIG. 5A, the second cylindrical body 62 of the vacuum pump P1 shown in FIG. 1A is made of a fiber-reinforced resin. The basic configuration of the vacuum pump P3 other than this configuration is the same as that of the vacuum pump P1 of FIG. 1A. Thus, in FIG. 5A, the same reference numerals are used to indicate the members same as those shown in FIG. 1A, and the detailed descriptions thereof are omitted accordingly.

As with the rotor 6 of the vacuum pump P1 of FIG. 1A, the rotor 6 of the vacuum pump P3 shown in FIG. 5A is configured in which the end portions of the first and second cylindrical bodies 61 and 62 are connected to each other by the connecting portion 60. However, the specific configuration of the rotor 6 including the specific configuration of the connecting portion 60 and the material of the second cylindrical body 62 is different from that of the rotor 6 of the vacuum pump P1 shown in FIG. 1A.

In other words, the connecting portion 60 of the rotor 6 of the vacuum pump P3 shown in FIG. 5A is configured by an annular plate 60A provided integrally with the lower end of the first cylindrical body 61 and an annular convex portion 60B provided integrally with the outer circumferential portion of the annular plate 60A, wherein the first cylindrical body 61 and the second cylindrical body 62 are connected integrally with each other by fitting the second cylindrical body 62 into the outer circumferential portion of the annular convex portion 60B.

In the rotor 6 of the vacuum pump P3 shown in FIG. 5A, the first cylindrical body 61, the annular plate 60A and the annular convex portion 60B are each made of a metallic material such as an aluminum alloy, whereas the second cylindrical body 62 is made of a fiber-reinforced resin lighter than the metallic material.

The balancing portions K1, K2, and K3 shown in FIGS. 1A and 1B and FIGS. 3A and 3B described in the first embodiment of the present invention can be applied to the vacuum pump P3 shown in FIG. 5A in which the second cylindrical body 62 of the rotor 6 is made of a fiber-reinforced resin.

Figure 6:
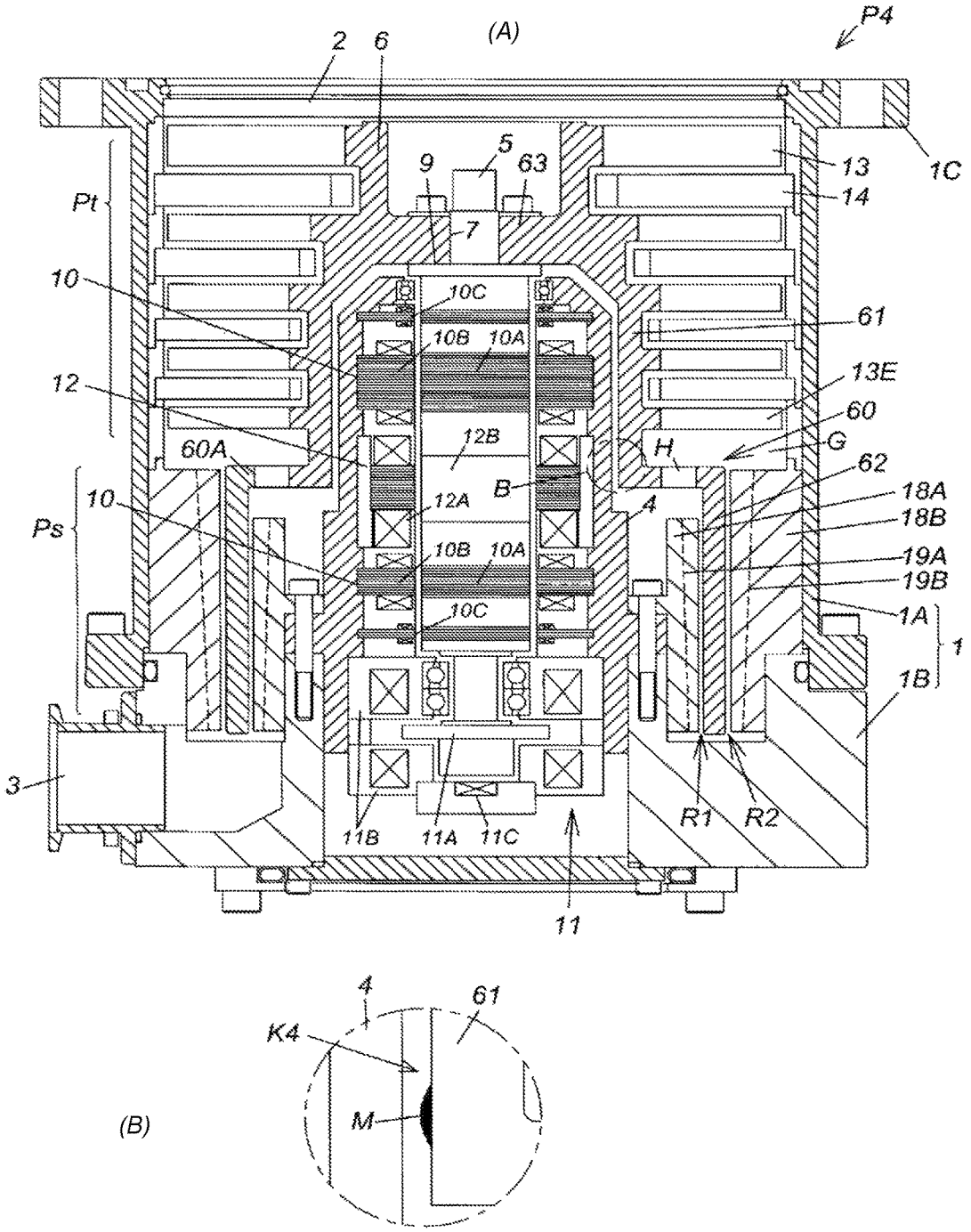
FIG. 6A is a cross-sectional diagram of a vacuum pump (threaded groove pump parallel flow type) according to fourth embodiment of the present invention.
FIG. 6B is an enlarged view showing a B portion shown in FIG. 6A.

FIG. 6A is a cross-sectional diagram of a vacuum pump (threaded groove pump parallel flow type) according to fourth embodiment of the present invention. FIG. 6B is an enlarged view showing a B portion shown in FIG. 6A.

The basic configuration of a vacuum pump P4 shown in FIG. 6A is the same as that of the vacuum pump shown in FIG. 1A. Thus, the same reference numerals are used to indicate the members same as those shown in FIG. 1A, and the detailed descriptions thereof are omitted accordingly.

The balancing portion K1 of the vacuum pump P1 shown in FIG. 1A has an inner diameter larger than that of the first cylindrical body 61. However, a balancing portion K4 of the vacuum pump P4 shown in FIG. 6A has an inner diameter of the same size as that of the first cylindrical body 61. In the vacuum pump P4 shown in FIG. 6A, the balancing portion K4 configured as described above is provided with the mass adding means M.

The balancing portion K4 shown in FIG. 6A can be applied to, for example, the vacuum pump P2 of FIG. 4A and the vacuum pump P3 of FIG. 5A.

As with the vacuum pump P1 of the first embodiment, in the vacuum pump P4 of the fourth embodiment, the balancing portion K4 of the rotor 6 is provided on the inner circumferential surface of the first cylindrical body 61 or connecting portion 60, and the threaded groove exhaust flow passages R1, R2 are not formed on the inner circumference side of the first cylindrical body 61 or connecting portion 60. Therefore, the same effects as those of the vacuum pump P1 of the first embodiment can be accomplished. In other words, the exhaust performance of the vacuum pump P4 can be improved, and problems such as the occurrence of fragments from the mass adding means M due to corrosion thereof can be prevented.

Furthermore, as with the vacuum pump P1 of the first embodiment, in the vacuum pump P4 of the fourth embodiment, the lower portion of the balancing portion K4 is opened downward, accomplishing the same effects as those of the vacuum pump P1 of the first embodiment. In other words, early discharge and early discovery of the fragments can be achieved, and balancing workability can be improved.

Figure 7:
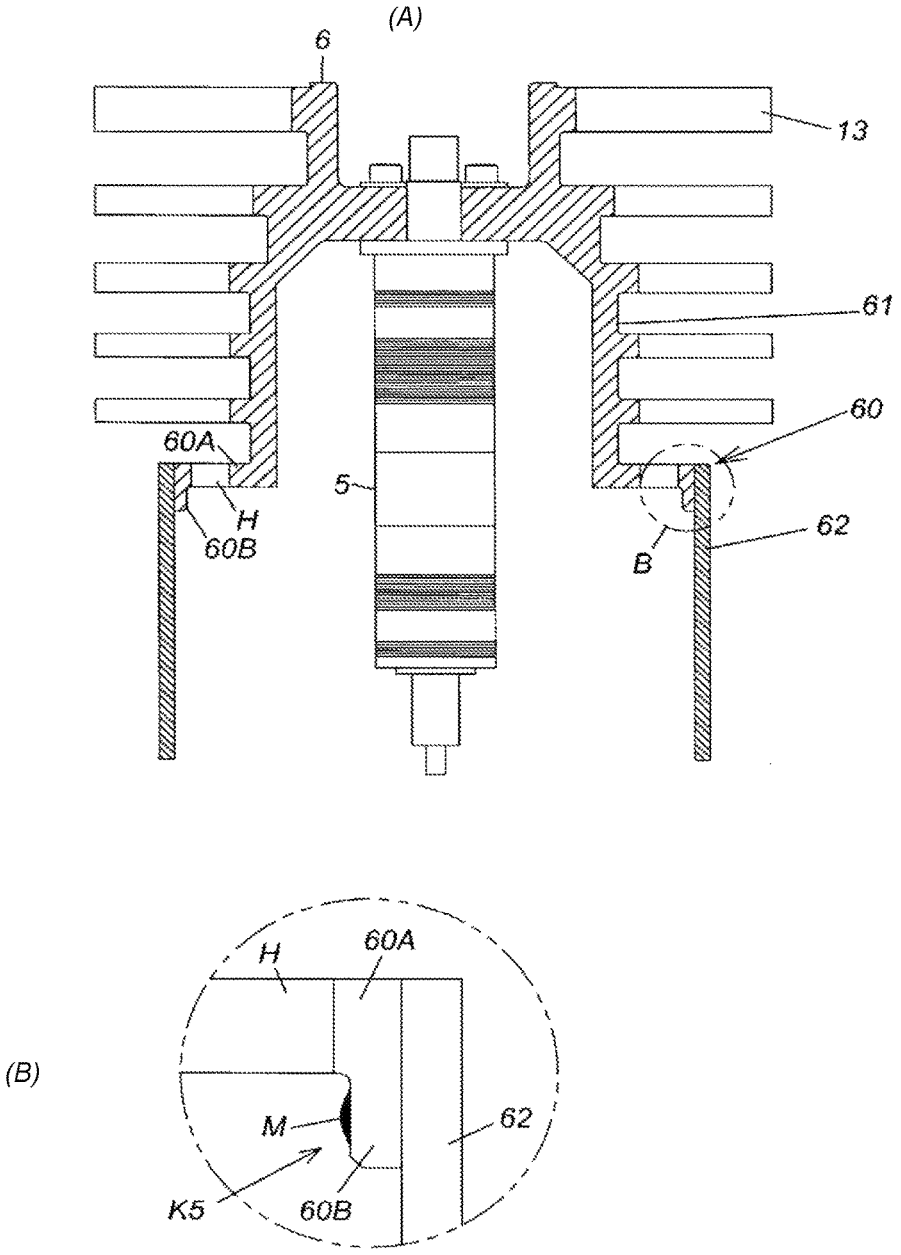
FIG. 7A is a cross-sectional diagram of a rotor of a vacuum pump according to fifth embodiment of the present invention.
FIG. 7B is an enlarged view showing a B portion shown in FIG. 7A.

FIG. 7A is a cross-sectional diagram of a rotor of a vacuum pump according to fifth embodiment of the present invention. FIG. 7B is an enlarged view showing a B portion shown in FIG. 7A.

The basic configuration of the rotor 6 of the vacuum pump shown in FIG. 7A is the same as that of the rotor 6 of the vacuum pump P3 shown in FIG. 5A. Thus, in FIG. 7A, the same reference numerals are used to indicate the members same as those shown in FIG. 5A, and the detailed descriptions thereof are omitted accordingly.

In the rotor 6 of the vacuum pump shown in FIG. 7A, the inner circumferential surface of the convex portion 60B of the connecting portion 60 is configured into a balancing portion K5, and the anti-corrosion mass adding means M is provided in this balancing portion K5. Although not shown, the tapered shape or the step portion shown in, for example, FIG. 1B and FIGS. 3A and 3B can be employed in this balancing portion K5.

In regard to the rotor 6 of the vacuum pump according to the fifth embodiment, the inner circumferential surface of the convex portion 60B is configured into the balancing portion K5 of the rotor 6, and the anti-corrosion mass adding means M is provided in this balancing portion K5, as described above. The threaded grooves 19A, 19B that configure the threaded groove exhaust flow passages R1, R2 are not formed on the inner circumferential surface of the convex portion 60B. Therefore, the exhaust performance of the vacuum pump can be improved without an impact of the balancing portion of the rotor 6 on the threaded groove exhaust portion Ps due to the presence of the mass adding means M on the inner circumferential surface of the convex portion 60B, or, more specifically, without having the effective thread length of the threaded groove exhaust portion Ps shortened by the presence of the balancing portion.

Also, the anti-corrosion mass adding means M is employed in the rotor 6 of the vacuum pump according to the fifth embodiment. Thus, even when the inner circumference of the convex portion 60B provided with the mass adding means M is configured as a flow passage communicated with the threaded groove exhaust flow passage R1, not only is it possible to prevent corrosion of the mass adding means M by the corrosive gas inside this flow passage, but also fracture of the mass adding means M due to corrosion can be avoided, preventing fragments from falling off the balancing portion K5. Furthermore, the possibility that such fragments flow out to a device located downstream of the vacuum pump along with the gas discharged from the vacuum pump can also be reduced significantly.

In the rotor 6 of the vacuum pump according to the fifth embodiment, the lower portion of the inner circumferential surface of the convex portion 60B is opened downward. For this reason, even when, for any reason, part of the mass adding means M on the inner circumferential surface of the convex portion 60B falls off in fragments, these fragments do not accumulate anywhere, but fall immediately and smoothly downward from the opened portion of the inner circumferential surface of the convex portion 60B (the lower portion of the inner circumferential surface of the convex portion 60B) without remaining anywhere, and then are discharged to the outside of the vacuum pump along with the gas exhausted from the vacuum pump. Consequently, in a case where such fragments are generated during the anti-corrosion test of the vacuum pump, early discharge and discovery of such fragments can be realized, preventing the fragments from flowing from the delivered vacuum pump to a device located upstream of the vacuum pump.

In the rotor 6 of the vacuum pump according to the fifth embodiment, the lower portion of the inner circumferential surface of the convex portion 60B is opened downward, as described above. Therefore, when, for example, a synthetic resin adhesive is used as the mass adding means M, the synthetic resin adhesive is applied to a tip end of a tool positioned substantially parallel to the inner circumferential surface of the rotor 6, and then the tip end of this tool can be inserted into the inner circumferential surface of the convex portion 60B from the opened portion of the inner circumferential surface of the convex portion 60B (the lower portion of the inner circumferential surface of the convex portion 60B) while moving the tool in parallel, thereby applying the synthetic resin adhesive (the mass adding means M) to a predetermined position of the inner circumferential surface of the convex portion 60B. In so doing, the tool does not need to be tilted, which can prevent the tool and the rotor shaft 5 from coming into contact with each other or interfering with each other and improve balancing workability.

FIG. 8A is a cross-sectional diagram of a vacuum pump (threaded groove pump parallel flow type) according to sixth embodiment of the present invention. FIG. 8B is an enlarged view showing a B portion shown in FIG. 8A.

The basic configuration of a vacuum pump P5 shown in FIG. 8A is the same as that of the vacuum pump P1 shown in FIG. 1A. Thus, in FIG. 8A, the same reference numerals are used to indicate the members same as those shown in FIG. 1A, and the detailed descriptions thereof are omitted accordingly.

The structural difference between the vacuum pump P5 shown in FIG. 8A and the vacuum pump P1 shown in FIG. 1A is that a bottom surface 60IN of the connecting portion 60 and the inner threaded groove exhaust portion stator 18A (stator portion) located at the bottom surface 60IN side face each other with a predetermined gap V therebetween, forming a stator seal portion 20 between the connecting portion 60 and the inner threaded groove exhaust portion stator 18A, wherein the stator seal portion 20 functions as a non-contact type seal in the range where the bottom surface 60IN of the connecting portion 60 and the inner threaded groove exhaust portion stator 18A face each other, to prevent the gas from flowing back towards the inner circumferential surface of the first cylindrical body 61 or the inner circumferential surface of the connecting portion 60. The predetermined gap V is set based on the level of shaking of the rotor upon activation of the vacuum pump P5, changes in size of the vacuum pump caused by thermal expansion, assembly errors, and the like. Note, in the present invention, that the predetermined gap V is set at approximately 0.5 mm to 3.0 mm as a small seal gap; however, the set value can be changed appropriately according to need.

In a specific configuration of the stator seal portion 20 of the vacuum pump P5 shown in FIG. 8A, for example, the stator seal portion 20 is formed integrally with a tip end portion of the inner threaded groove exhaust portion stator 18A; however, the configuration of the stator seal portion 20 is not limited thereto. For instance, the stator seal portion 20 may be formed as its own entity separately from the inner threaded groove exhaust portion stator 18A and then attached to the inner threaded groove exhaust portion stator 18A. In addition, the stator seal portion 20 may be integrally provided or attached to a stator portion inside the vacuum pump other than the inner threaded groove exhaust portion stator 18A, such as the stator column 4 (stator portion).

Incidentally, in the vacuum pump P1 shown in FIG. 1A, for example, some of the gas that is guided from the communication opening portion H of the connecting portion 60 toward the inner threaded groove exhaust flow passage R1 flows toward the outer circumference of the stator column 4 through between the inner threaded groove exhaust portion stator 18A and the connecting portion 60, and flows back toward the inner circumferential surface of the first cylindrical body 61 or the inner circumferential surface of the connecting portion 60. This backward flow of the gas can occur in any direction of the outer circumference of the stator column 4. Therefore, the non-contact seal is formed into a circle by forming the stator seal portion 20 into a circle so as to surround the outer circumference of the stator column 4.

Thus, according to the vacuum pump P5 shown in FIG. 8A, even when the gas that is guided from the communication opening portion H of the connecting portion 60 toward the inner threaded groove exhaust flow passage R1 is a corrosive gas, the non-contact type seal prevents the corrosive gas from flowing back towards the inner circumferential surface of the first cylindrical body 61 or of the connecting portion 60. Therefore, it is unlikely that the inner circumferential surface of the first cylindrical body 61 or of the connecting portion 60 is exposed to the corrosive gas.

Incidentally, as with the vacuum pump P1 shown in FIG. 1A, the vacuum pump P5 shown in FIG. 8A has the balancing portion K1 of the rotor 6 provided on the inner circumferential surface of the first cylindrical body 61 or of the connecting portion 60, and the mass adding means M is provided in this balancing portion K1. However, in the vacuum pump P5 shown in FIG. 8A, the backward flow of the corrosive gas described above is prevented from taking place in the region where the mass adding means M is provided, i.e., the inner circumferential surface of the first cylindrical body 61 or of the connecting portion 60. Thus, it is unlikely that the mass adding means M is exposed to the corrosive gas, further effectively preventing the occurrence of fragments of the mass adding means M due to corrosion thereof.

The non-contact type seal of the vacuum pump P5 shown in FIG. 8A can be applied to the vacuum pump P1 shown in FIG. 1A and the vacuum pumps P2, P3 and P4 shown in, for example, FIGS. 4A, 5A and 6A.

The foregoing embodiments and modifications can be combined in various ways. For example, balancing of the rotor can be accomplished by both the first and fifth embodiments.

EXPLANATION OF REFERENCE NUMERALS

1: Exterior case; 1A: Pump case; 1B: Pump base; 1C: Flange; 2: Gas inlet port; 3: Gas outlet port; 4: Stator column; 5: Rotor shaft; 6: Rotor; 60: Connecting portion; 60IN: Inner surface of connecting portion; 60A: Annular plate; 60B: Annular convex portion; 61: First cylindrical body; 62: Second cylindrical body; 63: End member; 7: Boss hole; 9: Shoulder portion; 10: Radial magnetic bearing; 10A: Radial electromagnetic target; 10B: Radial electromagnet; 10C: Radial displacement sensor; 11: Axial magnetic bearing; 11A: Armature disc; 11B: Axial electromagnet; 11C: Axial displacement sensor; 12: Drive motor; 12A: Stator; 12B: Rotator; 13: Rotor blade; 13E: Lowest rotor blade; 14: Stator blade; 18A: Inner threaded groove exhaust portion stator (stator member facing inner circumferential surface of second cylindrical body); 18B: Outer threaded groove exhaust portion stator (stator member facing outer circumferential surface of second cylindrical body); 19A, 19B: Threaded groove; 20: Stator seal portion; BC: Conventional balancing portion; D: Balancing groove; G: Final gap (gap between lowest rotor blade and upstream end of communication opening portion); H: Communication opening portion; K1, K2, K3, K4: Balancing portion; M: Mass adding means; P1, P2, P3, P4, P5, P6: Exhaust pump; Pt: Blade exhaust portion; Ps: Threaded groove exhaust portion; R1: Inner threaded groove exhaust passage; R2: Outer threaded groove exhaust passage; S: Step portion; T: Tool; V: Predetermined gap (small seal gap).

What is claimed is:

1. A rotor of a vacuum pump for exhausting gas from a chamber, the rotor comprising:

a first cylindrical body;

a second cylindrical body; and a connecting portion that connects end portions of the first and second cylindrical bodies together, wherein:

the first cylindrical body comprises a plurality of rotor blades on an outer circumferential surface thereof, and further comprises a blade exhaust portion when the rotor blades are arranged along an axial center of the vacuum pump alternately with a plurality of stator blades, the second cylindrical body comprises a threaded groove exhaust portion when a threaded groove exhaust flow passage is formed at least on an inner circumference of the second cylindrical body, a balancing portion for the rotor is provided on an inner circumferential surface of the first cylindrical body or the connecting portion, the balancing portion being provided with mass adding means, an inner diameter of an inner circumferential surface of the balancing portion is larger than an inner diameter of the first cylindrical body, and the inner diameter of the inner circumferential surface of the balancing portion on which the mass adding means is provided is constant or becoming greater toward a lower portion thereof.

2. The rotor according to claim 1, wherein the balancing portion is formed into a tapered shape in which a part thereof close to the connecting portion is deep and a part thereof away from the connecting portion is shallow.

3. The rotor according to claim 1, wherein the balancing portion is formed into a stepped shape in which a step portion is provided in the middle of the balancing portion, and with the step portion as a boundary, a region of the balancing portion that is close to the connecting portion is deep and a region of the balancing portion away from the connecting portion is shallow.

4. The rotor according to claim 1, wherein the connecting portion functions as a non-contact seal for preventing the gas from flowing back toward the inner circumferential surface of the first cylindrical body or the inner circumferential surface of the connecting portion when the connecting portion and a stator portion face each other with a predetermined gap therebetween.

5. The rotor according to claim 4, wherein the predetermined gap is between 0.5 mm and 3.0 mm.

6. The rotor according to claim 1, wherein the second cylindrical body is made of fiber-reinforced resin.

7. A vacuum pump comprising a rotor comprising:

a first cylindrical body;

a second cylindrical body; and a connecting portion that connects end portions of the first and second cylindrical bodies together, wherein:

the first cylindrical body comprises a plurality of rotor blades on an outer circumferential surface thereof, and further comprises a blade exhaust portion when the rotor blades are arranged along an axial center of the vacuum pump alternately with a plurality of stator blades, the second cylindrical body comprises a threaded groove exhaust portion when a threaded groove exhaust flow passage is formed at least on an inner circumference of the second cylindrical body, a balancing portion for the rotor is provided on an inner circumferential surface of the first cylindrical body or the connecting portion, the balancing portion being provided with mass adding means, an inner diameter of an inner circumferential surface of the balancing portion is larger than an inner diameter of the first cylindrical body, and the inner diameter of the inner circumferential surface of the balancing portion on which the mass adding means is provided is constant or becoming greater toward a lower portion thereof.

8. The rotor according to claim 2, wherein the connecting portion functions as a non-contact seal for preventing the gas from flowing back toward the inner circumferential surface of the first cylindrical body or the inner circumferential surface of the connecting portion when the connecting portion and a stator portion face each other with a predetermined gap therebetween.

9. The rotor according to claim 3, wherein the connecting portion functions as a non-contact seal for preventing the gas from flowing back toward the inner circumferential surface of the first cylindrical body or the inner circumferential surface of the connecting portion when the connecting portion and a stator portion face each other with a predetermined gap therebetween.

10. The rotor according to claim 8, wherein the predetermined gap is between 0.5 mm and 3.0 mm.

11. The rotor according to claim 9, wherein the second cylindrical body is made of fiber-reinforced resin.

12. A vacuum pump comprising a rotor comprising:

a first cylindrical body;

a second cylindrical body; and a connecting portion that connects end portions of the first and second cylindrical bodies together, wherein:

the first cylindrical body comprises a plurality of rotor blades on an outer circumferential surface thereof, and further comprises a blade exhaust portion when the rotor blades are arranged along an axial center of the vacuum pump alternately with a plurality of stator blades, the second cylindrical body comprises a threaded groove exhaust portion when a threaded groove exhaust flow passage is formed at least on an inner circumference of the second cylindrical body, a balancing portion for the rotor is provided on an inner circumferential surface of the first cylindrical body or the connecting portion, the balancing portion being provided with mass adding means, the balancing portion has an inner diameter larger than that of the first cylindrical body, the inner diameter of the balancing portion being constant or becoming greater toward a lower portion thereof, and the connecting portion functions as a non-contact seal for preventing the gas from flowing back toward the inner circumferential surface of the first cylindrical body or the inner circumferential surface of the connecting portion when the connecting portion and a stator portion face each other with a predetermined gap therebetween.

* * * * *